United States Patent [19]

Stoll et al.

[11] Patent Number: 4,700,616

[45] Date of Patent: Oct. 20, 1987

[54] PISTON AND CYLINDER UNIT

[76] Inventors: Kurt Stoll, Lenzhalde 72, 7300 Esslingen; Gerhard Hihn, Schurwaldstr. 7, 7300 Esslingen-Berkheim, both of Fed. Rep. of Germany

[21] Appl. No.: 910,394

[22] Filed: Sep. 22, 1986

[30] Foreign Application Priority Data

Sep. 24, 1985 [DE] Fed. Rep. of Germany ..... 3534000

[51] Int. Cl.[4] ..... F15B 15/20

[52] U.S. Cl. ..... 92/118; 92/59; 92/161; 74/522

[58] Field of Search ..... 92/59, 117 R, 117 A, 92/118, 161; 74/522, 837

[56] References Cited

U.S. PATENT DOCUMENTS

| | | | |
|---|---|---|---|
| 1,385,215 | 7/1921 | Lidstone | 92/118 X |
| 3,897,833 | 8/1975 | Frisbo | 92/161 X |
| 4,085,660 | 4/1978 | Yoshinouchi et al. | 92/161 X |
| 4,534,278 | 8/1955 | Spidle | 74/522 X |

*Primary Examiner*—A. Michael Chambers
*Assistant Examiner*—John C. Fox
*Attorney, Agent, or Firm*—McGlew and Tuttle

[57] ABSTRACT

The invention relates to a cylinder and piston unit with a cylinder tube closed at both its ends by cylinder end caps. An axially moving piston in the cylinder has a piston rod extending sealingly through at least one end cap. On the outer face of the tube there are four longitudinal means such as longitudinal ribs or round tie rods extending in the axial direction of the tube and equally spaced in the circumferential direction about the tube. Furthermore there is a mounting yoke for pivotally carrying the cylinder and piston unit and having at least two, and more especially four, generally diametrally opposite clamping jaws with trunnions on two of them. The mounting means furthermore constitutes an annular structure encircling the tube. At their ends the clamping jaws have gripping faces adapted to engage and grip the longitudinal ribs or rods on opposite sides thereof so that the tube is held firmly by clamping the jaws together.

20 Claims, 2 Drawing Figures

PISTON AND CYLINDER UNIT

BACKGROUND OF THE INVENTION

The invention relates to piston and cylinder units and more particularly to such a unit whose cylinder tube, which contains an axially running piston driving a piston rod extending through a packing in at least one of two cylinder end caps mounted on the cylinder ends, is provided with trunnions so that after the unit has been mounted on some supporting structure it may be rocked about the trunnion axis which is perpendicular to the cylinder tube axis.

In all cases in which a part of a mechanical system, such as a machine part or the load carrying part of a tipper truck, has to be tilted or swung by a piston and cylinder unit, the piston and cylinder unit itself also has to be pivotally mounted, as for example by trunnions welded on the cylinder tube which are carried in bearings or the like. A disadvantage in this respect is that such welding operations may well lead to a deformation of the cylinder tube so that the piston will no longer run smoothly inside it. Furthermore, with such arrngements it is practically impossible to change the position of the pivot axis, although such a modification is frequently required, if the angle of pivot of the piston and cylinder unit is to be altered. The only remedy would then be to cut off the trunnions on the piston and cylinder unit and weld new ones on in a different position. This however tends to be highly inconvenient and it is often very difficult to so perfectly align the trunnions that they have a true fit in the bearings already existing in the arrangement.

SHORT SUMMARY OF THE INVENTION

One object of the present invention is to remedy these shortcomings of the prior art.

In accordance with a more specific aspect of the invention, the intention is to devise a piston and cylinder unit of the initially specified type which ensures a simple possibility of altering the position of the pivot axis on, and in relation to the cylinder tube so that in its new position the trunnions will not twist or slip in relation to the cylinder tube.

A still further aim of the invention is to devise such a piston and cylinder unit which may be simply produced at a low price.

In order to achieve these and other objects of the invention as appearing from the present specification and claims, a piston and cylinder unit of the type specified is characterized by having four axis-parallel tie means regularly circumferentially spaced on the tube, a mounting yoke means having at least two clamping jaws each carrying a trunnion and arranged on the outside of the cylinder tube to grip the tie means without making contact with the tube. The clamping jaws are so arranged that, in relation to the longitudinal axis of the said tube they are diametrally opposite to each other and may be detachably joined together so as to form a structure fitting around the cylinder tube. Each such clamping jaw has two clamping faces exactly aligned with one of the tie means so that such surface may be engaged with parts of the outer surfaces of two tie rods which with respect to the outer face of the cylinder tube are circumferentially adjacent may be firmly clamped against such surface parts. Accordingly, after slackening off the connection between the two clamping jaws and the longitudinal tie means, the mounting yoke means in keeping with the invention may therfore be slipped along the length of the cylinder tube and locked at a new desired setting by tightening up the clamping jaws so that the jaws grip the tie means, and are firmly located on the piston and cylinder unit.

Consequently it becomes a simple matter to alter the positions of the pivot axis. In the locked condition of the mounting means the clamping jaws of the clamping jaws engage the tie means and are clamped onto them, while the outer tubular surface of the cylinder tube is not in contact with the clamping jaws. This results on the one hand in a keying of the tube in the clamping jaws in the sense that the tube is not able to be twisted in the jaws about its axis and on the other hand in protection of the cylinder tube against deformation even if the jaws extert a massive gripping force as is frequently required for heavy duty piston and cylinder units in order to prevent an undesired shift in the position of the pivot or trunnion axis. A further advantage of the arrangement in accordance with the present invention is due to the fact that, if needed, the pivot axis may be shifted around the longitudinal axis of the cylinder tube, such a shift being in steps of 90° assuming that there are four tie means equally spaced by 90°. Furthermore, pre-existing piston and cylinder units may be equipped with the mounting means inasfar as the same may be fitted to practically all types of piston and cylinder units with tie rods or other longitudinal structures on the tube.

Advantageous further developments of the invention are defined in the claims. In accordance with one such further feature of the invention, the clamping faces of the jaws have parts complementary to the outer faces of the tie means where they are to engage them. This feature of the invention means that a large contact interface is present between the jaws and the tie means so that the jaws securely lock onto the tie means. In addition the clamping jaws are perfectly set in a direction that is transverse to the pivot axis and accordingly transverse forces may be taken up witout any trouble and without any danger of an undesired shifting in the setting of the pivot axis.

In keeping with a further feature the mounting yoke means is in the form of an annular structure completely encircling the cylinder tube and which has interruptions adjacent to the respective tie means so as to be divided up into four separate clamping jaws placed opposite to each other in pairs and which adjacent to their interruptions have ends with clamping faces adapted to engage a part of the outer face of the respective tie means and arranged substantially diameterally opposite clamping faces on circumferentially adjacent clamping jaws, so that the clamp faces of two adjacent jaws engage opposite sides of said tie means, there being a detachable connecting means between the respective clamping jaws. This further feature of the invention makes it possible to ensure that generally diameterally opposite each clamping face of a clamping jaw carrying a trunnion there is the clamping face of a further, untrunnioned clamping jaw. If now the connecting means are used to draw the adjacent clamping jaws together at such an interruption, the two clamping faces will be moved towards each other and press on opposite side of the same tie means. The outcome of this is an equalisation of the transverse forces acting on the tie means so that there is no question of its being bent to the side and being damaged. Nevertheless, the cylinder tube then still remains free of external transverse forces so that there is no chance of the tube being deformed. The four-part design of the mounting yoke means furthermore facilitates assembly from outside on the tie means or the cylinder tube. Moreover, simply by releasing the connections at the interruptions in the clamping jaws it is possible for the mounting means to be slackened off and for the clamping jaws to be readily slipped along in the longitudinal direction of the cylinder tube. Furthermore, the mounting means may be universally employed and fitted to any desired type of piston and cylinder unit.

As part of the further developments of the invention the four clamping jaws are placed at a right angle to each other as considered in the longitudinal direction of the cylinder tube and represent a rectangular or square ring structure, the clamping jaws respectively extending parallel to that plane which contains the axis of the tie means with which they are engaged, and furthermore the clamping jaws carrying the trunnions are longer than the two other clamping jaws which are arranged with a degree of play (owing to the interruptions) between their end parts. The interruptions may be arranged in two parallel planes with the clamping faces of either of the trunnioned jaws being in a single plane. These further features of the innovation enable a firm clamping action on the tie means between the two clamping faces respectively associated therewith, for owing to the fact that the interruptions maintain a respective gap between the adjacent clamping jaws there is no possibility of the clamping jaws coming into contact with each other prior to full clamping onto the tie means. It is furthermore possible for clamping faces of the clamping jaws bearing the trunnions to extend around a major part, not exceeding the half thereof, of the periphery of the respective tie means.

In a further feature of the invention the clamping faces of the clamping jaws bearing the trunnions are in the form of recesses, which are complementary in form to the outer circumference of the respective tie means, in the inner side of the clamping jaw adjacent to the cylinder tube. Furthermore, the clamping faces of the shorter clamping jaws placed between the clamping jaws having the trunnions are arranged in the transition between the interruptions and the inner side of the jaw facing the cylinder tube and have a facet adapted to the form of the related outer circumference part of the associated tie means, such facet being complementary thereto and having an arcuate or possibly linear form. The linear or arcuate length of these clamping faces, extending in the peripheral direction of the respective tie means, of the trunnioned clamping jaws is larger than that of the clamping jaws or bars which are not made with such trunnions.

It is furthermore possible for the clamping jaw parts, located between the clamping faces of each clamping jaw and facing the cylinder tube, to extend inwards between the respectively adjacent tie means and on the inner side of the jaws turned towards the cylinder tube they may have an outline which is complementary to the outline of the cylinder tube between the tie means.

In accordance with a still further feature of the invention the clamping faces of two clamping jaws, adjacent to an interruption, merge with each other in an aligned manner so as to leave a separating gap, and form the limit of a clamping recess which is U-like as seen in the longitudinal direction of the cylinder with the sides of the recess directed radially inwards towards the cylinder tube from the rounded end of the U-like form.

These further features of the invention make it possible for the clamping faces to cover a major part of the outer circumference of the tie means so that the clamping jaws are supported on the tie means in the best possible manner and there is no chance of their sliding off them. These further features facilitate the placement of the individual clamping jaws.

It is furthermore possible for there to be a gap, in the condition in which the clamping faces are applied to the tie means, between the outer circumference of the cylinder tube and the facing inner sides of the clamping jaws. This ensures that there is no chance of damage to the cylinder tube by lateral forces acting thereon.

The tie means may take the form of longitudinal ribs on the cylinder tube as an integral part of it, and it is possible for there to be screws received in tapped holes at the ends of the ribs to attach the end caps onto the ends of the cylinder.

This further development of the invention will ensure that the tie means always have a given position about the axis of the cylinder tube so that the pivot axis may be accurately set on the tube many times over. Furthermore, the external forces acting, on the mounting means in the circumferential direction of the cylinder tube, may be optimally resisted without the longitudinal ribs changing their relative positions on the outer periphery of the cylinder tube, for instance due to bending. The result is therefore a torsionally stiff structure.

As part of a still further possible feature of the invention the longitudinal ribs have a U-like outline with one end of the outline formed on the outer periphery of the cylinder tube. The bearer faces formed by the respective U-legs of the outline of the ribs are sloped so as to converge towards each other radially towards the cylinder tube, or conversely, the two bearer faces diverge slightly from each other in a radially outward direction.

This further development predicates a decrease in the thickness of the longitudinal ribs towards the cylinder tube so that clamping jaws are not only held non-positively on the longitudinal ribs but also by an interlock.

The invention will now be explained in more detail with reference to the accompanying figures.

LIST OF THE FIGURES OF THE DRAWINGS

DETAILED ACCOUNT OF WORKING EXAMPLE OF THE INVENTION

Figure 1:
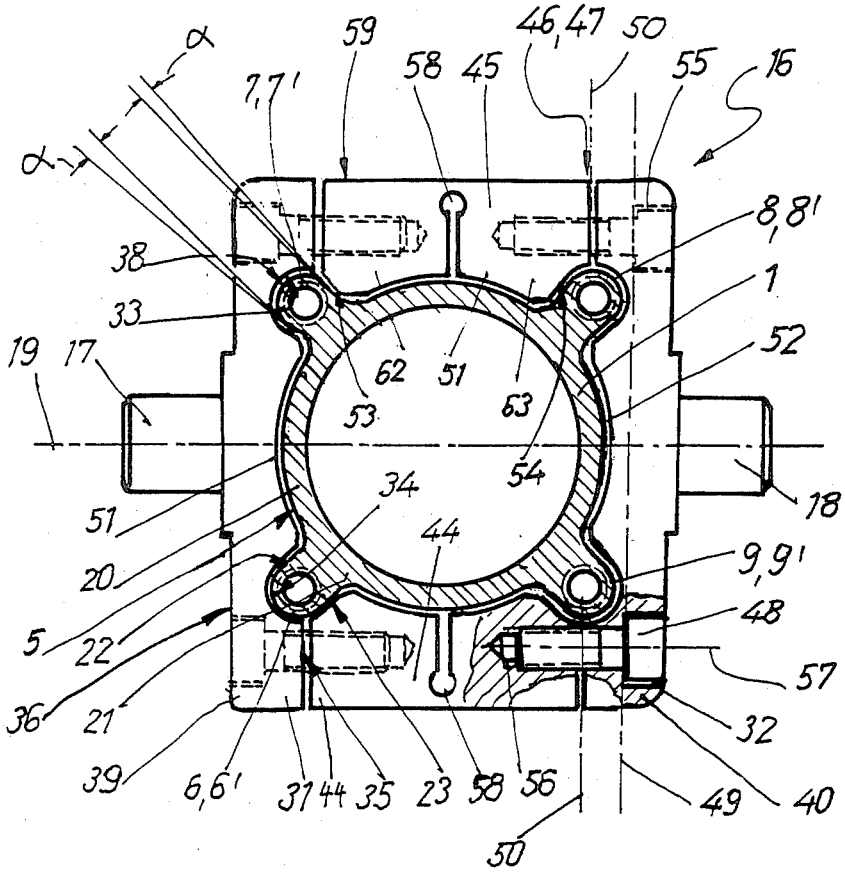
FIG. 1 is an end-on view of the piston and cylinder unit in keeping with the invention sectioned on the line I—I of FIG. 2.

The piston and cylinder unit illustrated in the figures possesses a cylinder tube 1 with a generally circular cross section and end caps 2 and 3 fitted on its ends to produce a seal. A piston, not shown, is able to reciprocate in the interior of the cylinder tube in an axial direction and with a piston rod 4 extending from it which runs coaxially through a packing in the end cap 3. On the outer face of the cylinder tube 1 there are four longitudinal ribs 6, 7, 8 and 9 running parallel to its axis and serving to hold on the two end caps inasfar as the caps 2 and 3 are screwed to their ends. Accordingly the longitudinal ribs may be considered to be tie means having the function of tie rods. Furthermore, there is a yoke mounting means 16 for pivotally supporting the piston and cylinder unit on some fixed structure. This mounting means is secured to the outside of the cylinder tube and has two radially extending trunnions 17 and 18 that project out diametrially from the cylinder axis 10 and thus radially away from the cylinder tube. The trunnions enable the mounting means to be supported in pillow bearings, bearing eyes or the like (not shown), so that the mounting means may be rocked. The common axis 19, perpendicular and radial in relation to the longitudinal axis of the cylinder tube, is the axis of rocking of the mounting means.

In present working example of the invention the four longitudinal ribs 6 through 9 are in the form of tie means 6', 7', 8' and 9' integral with the cylinder tube 1. In other words, the tube is basically in the form of a circular cylinder which has four lugs extending from it, and the cylinder has a constant cross section along its length.

The longitudinal ribs 6 to 9, have a generally U-like cross section springing out from the otherwise circular outline of the cylinder tube. The rounded ends of the U-cross sections are remote from the outer face 5 of the cylinder tube and the other ends 21 are adjacent thereto. Accordingly each longitudinal rib 6 through 9 has two bearer faces 22 and 23 extending in the longitudinal direction of the cylinder tube and projecting generally at a right angle from the outer face 5 of the tube, that is to say generally radially, and at their outer ends the bearer faces 22 and 23 are connected by the rounded end surfaces completing the U-form radially furthest from the tube.

The length of the longitudinal ribs 6 to 9 is generally the same as the length of the rest of the cylinder tube 1. There are tapped holes 24 in the end of each longitudinal rib 6 to 9, see FIG. 2. The cylinder caps 2 and 3 have through holes 25 aligned with the tapped holes 24 to receive respective attachment screws 29 screwed into the tapped holes 24. Accordingly the cylinder end caps 2 and 3 are detachably secured to the end faces 14 and 15 of the tubular section 20. The cylinder caps 2 and 3 have ports 30 and 30' marked in chained lines and extending from the outside into one of the two working spaces on the two sides of the piston, not shown, so that by admitting air into one piston space and venting it from the other piston space the piston may be caused to reciprocate in the cylinder with its piston rod.

At this juncture it is to be noted that the mounting means described in the following account is not merely suitable for use in connection with tubular sections of the type described but may be used in fact with any type of piston and cylinder unit which has a cylinder tube with tie rods externally arranged thereon. In other words it is not necessarily the case that, as here, the "tie rod means" are an integral part of the cylinder. However, the mounting means does have especial advantages in connection with a tubular section as opposed to a plain tube with four separate tie rods.

A more particularly important feature of the present invention is that the mounting means has two clamping jaws 31 and 32 arranged on the outside of the cylinder tube 1 without making contact with its outer cylinder surface. These clamping jaws are arranged diametrally opposite each other on the two sides of the longitudinal axis 10 of the cylinder tube 1. The clamping jaws are so detachably joined together that the mounting means 16 forms a structure that completely encircles the tubular section 20. Each of the two clamping jaws 31 and 32 has one of the two trunnions 17 and 18 on its outer sides 36 turned away from the tubular section. Furthermore, on an inner face 35 adjacent to the tubular section 20 each of the two clamping jaws 31 and 32, has two clamping faces 33 and 34 are each exactly opposite one of the longitudinal ribs. Moreover, each clamping jaw 31 and 32 is so designed that its two clamping surfaces 33 and 34 may be simultaneously applied to parts of the outer face 38 of two longitudinal ribs 6, 7, 8, 9 which are adjacent to each other in the circumferential direction of the cylinder tube 1, and it may be firmly clamped against such faces.

The two clamping jaws 31 and 32 may therefore be so clamped by their releasable connection that their clamping faces 33 and 34 engage the outer faces of the longitudinal ribs 6 through 9 and grip them tightly. Accordingly the mounting means 16 may be firmly fixed on the cylinder tube 1 without any chance of slip. However to adjust the setting of the mounting means along the cylinder tube it is only necessary to slacken the means connecting the clamping jaws and it is not necessary to completely detach the mounting means from the cylinder.

Figure 2:
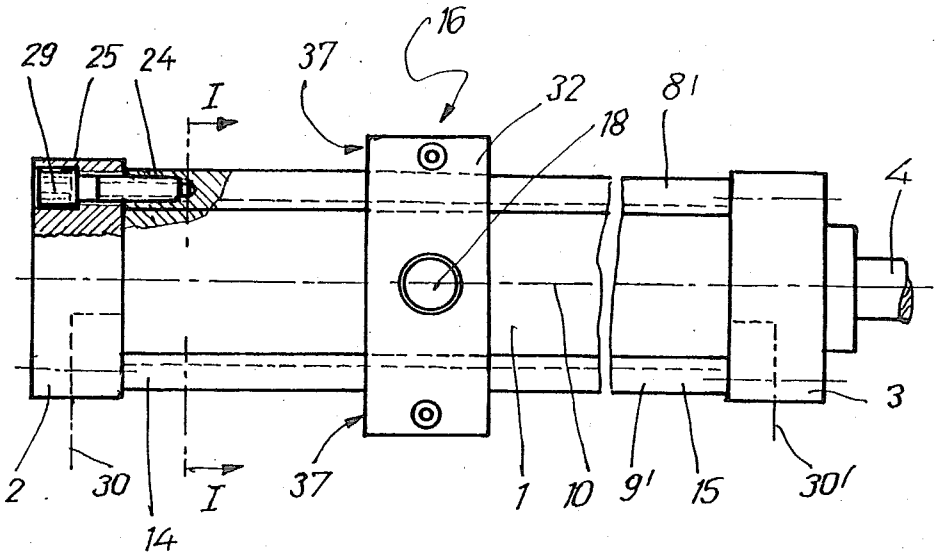
FIG. 2 is an elevation of the unit of FIG. 1.

The two clamping jaws 31 and 32 each possess a generally prismatic basic form and in side elevation as in FIG. 2 will be seen to have a preferably rectangular outline when looked at in the direction of the trunnion axis 19. The trunnions 17 and 18 are respectively attached on the outer side 36. The length of the jaws in a direction perpendicular to the trunnion axis 19 and the longitudinal axis 10, of the two clamping jaws 31 and 32 is greater than the size of the diameter of the cylinder tube and of the distance between two longitudinal ribs. Thus the clamping jaws, as seen in the side elevation as in FIG. 2, extend in their length directions at a right angle to the longitudinal axis 10 a distance 37 above and below the tubular section. The clamping faces 33 and 34 are in the form of recesses in the inner side 35 of the clamping jaws, and the spacing between them is equal to the distance between adjacent ribs 6, 7, 8 and 9 as measured in the circumferential direction. The form of the recesses is adapted to match the part of the outer rib circumference 38 which they engage.

When the tubular section 20 is mounted, the clearance distance between two opposite ends 39 and 40 of the two clamping jaws is approximately equal to the linear distance between two circumferentially adjacent longitudinal ribs. Two further, shorter jaws 44 and 45 without trunnions are placed in the two spaces between the ends of the trunnioned jaws 32 and 33. To the outside these shorter are aligned with the ends 39 and 40. At their mutually adjacent end parts the jaws 32, 33, 44 and 45 are detachably joined together by screws 48. As considered in cross section the mounting means 16 therefore has the form of a ring with a substantially rectangular or square form, the respectively opposite clamping jaws 31 and 32 and furthermore the shorter jaws 44 and 45 being placed in mutually parallel planes. In addition the respective longitudinal axis of a jaw 31 or 32; 44 or 45 extending between the end parts adjacent to adjacent jaws (for instance at 49) runs parallel to one plane (as for instance 50) containing the axis of two respective ribs (f. i. 8 and 9) engaged by the respective jaw (f. i. 32).

The configuration of the mounting yoke means may be alternatively described from a different aspect by saying that the mounting means 16 is to be looked upon as a square ring completely encircling the cylinder tube. This ring structure is divided by an interruption 47, in the form of a gap 46, at each respective tie means 6' through 9' or longitudinal rib 6 through 9 so as to result in jaws (longer clamping jaws and shorter clamping jaws with and without trunnions) which are placed in pairs with the two members of each pair opposite and parallel to each other and at the gaps the 47 the adjacent jaws are detachably connected with each other by clamping screws 48 so that the ring structure is completed. The shorter jaws 44 and 45 without trunnions are overlapped with play by the end parts 39 and 40 of the trunnioned clamping jaws 31 and 32.

The interruptions of each one of the two clamping jaws 31 and 32 are aligned with a common plane and the two planes are parallel to each other while at the same time being parallel to the longitudinal axis 49 of the respective clamping jaws.

The inner face, turned towards the tubular section 20, of the mounting yoke means 16, that is to say of the annular structure constituted by the jaws, is essentially complementary to the outer face of the tubular section 20 between the ribs. This means that the individual longer and shorter jaws 31, 32, 44 and 45 have an arcuate recess 52 on the parts 51 of their inner sides between two longitudinal ribs, and the radius of curvature of such recesses 52 is approximately equal to that of the outer face 5 of the tubular section. As seen in the axial direction of the individual jaws there is a clamping face merging with the respective recess 52. In this respect, as already noted, the clamping faces of the clamping jaws 31 and 32 are in the form of recesses in the inner side 35. On the other hand, the clamping faces, termed opposite faces 53 and 54 for convenience of description, of the shorter jaws 44 and 45 are provided directly on the part between a respective interruption 47 and the inner side 35 of a jaw. The opposite faces also possess a shape adapted to correspond to a part of the outer periphery 38 of the longitudinal ribs and are more or less in the form of facets. The respectively opposite recess-like clamping faces and opposite facet-like faces form a practically uninterrupted face, whose shape is the same as the outer form of the respective longitudinal ribs 6 through 9 having a generally U-like cross section. This combined surface is subdivided by the separating gaps 46 into the two surface section of the recess-like clamping and facet-like opposite faces.

The subdivision into the clamping and opposite faces is preferably such as to ensure that the recess-like and opposite facet-like faces at each longitudinal rib are diametrally or generally diametrally opposite to each other about the rib, for the intention is to ensure that on clamping two jaws together by the clamping screws there is a clamping of the respective longitudinal rib, more especially the two opposite bearer faces 22 and 23 which are opposite to each other and to which a gripping force is applied. It is for this reason an advantage if the clamping faces 33 and 34 of the clamping jaws are so designed that they encompass the respective longitudinal rib or the longitudinal flange on the cylinder for a major part of its periphery but not more than half of it. This leads on the one hand to an even distribution of the clamping surface pressure so that the longitudinal ribs are not deformed by squeezing, and on the other one may be certain that the clamping jaws may be readily mounted on the tubular section without any trouble. The size of the opposite faces 53 and 54, whose length in the circumferential direction of each longitudinal rib or arc length is less than that of the respective clamping face is correspondingly less.

Owing to the configuration of the clamping and opposite faces in the form of recesses and facets, it becomes possible to move the longer clamping jaws and the shorter jaws very close to the outer face 5 of the cylinder tube 1, for the jaw parts 51 having the recesses 52 may extend inwards between the respectively adjacent longitudinal ribs; this is made possible by their arcuate shape. However the size of the distance between the clamping faces 33 and 34 and the opposite faces 53 and 54 of a given jaw is so selected in relation to the distance between the respective longitudinal ribs or radial flanges that in the mounted condition, the clamping and opposite faces applied to parts of the longitudinal ribs do not make contact with the outer cylindrical face of the cylindrical tube and in fact between the arcuate limiting face of a given recess 52 and the opposite outer face 5 of the cylindrical tube there is a gap.

There are the four clamping screws 48, which extend from the outer side 36 of the clamping jaws 31 and 32, through holes 55 extending through these jaws and are screwed into tapped holes 56, coaxially aligned with the holes 55, in the shorter jaws 44 and 45. The through holes 55 are located in every end part 31 and 32 of the clamping jaws and the tapped holes 56 are made extending into the shorter jaws from the end faces turned towards these end parts. The axial direction 57 of the through and tapped holes is in each case preferably at a right angle to the adjacent separating gap 46. This enbales one to provide a highly efficient clamping together of the two jaws.

When fitting the mounting means 16 on a tubular section or on a tube with a plain cylindrical outer face and separate round tie rods, firstly all the clamping screws 48 are put in place and are then evenly tightened. In order then to make certain that the opposite faces 53 and 54 make full contact with the respective longitudinal rib or the longitudinal flange, there is a further provision in accordance with the present invention that that the shorter jaws 53 and 54 have radial keyhole slots 58 which extend radially out from the cylinder tube. The slots 58 extend from the inner side 35 towards the opposite outer side 59 of the shorter jaws but come to an end short of it. Such a radial slot 58 is an expansion slots that enables expansion of the shorter jaws to take place, that endows the shorter jaws with a certain degree of elasticity and accordingly it is possible for the jaws sections 62 and 63 of each shorter jaw placed on the two sides of a longitudinal slot 58 to move apart when the clamping screws are tightened up. That is to say, the longitudinal slot 58 is opened out during the process of applying the clamping force.

Owing to the presence of the expansion slots the shorter jaws may be made with a substantially larger tolerance than might otherwise be the case so that production may take place at a lower price, for if the shorter jaws were completely stiff it would not be possible in all cases to ensure that the opposite faces 53 and 54 would make firm engagement with one of the bearer side faces 23 of the longitudinal ribs when the clamping force had been fully applied.

The mounting means is very efficiently held in place on the cylinder tube without any chance of damaging it, for example by deformation, since when the mounting means 16 is fitted in place it grips each longitudinal rib at generally diametrally opposite parts of its surface. At the same time the transverse forces acting on each longitudinal rib are generally in balance in the sense that there are no forces causing a bending effect and accordingly the longitudinal rib itself will not suffer any damage. This particular advantage of using the mounting means of the invention with the tubular section stems from the fact that the longitudinal ribs are securely integral with the cylinder tube so that the mounting means itself is rigidly held in the circumferential direction of the cylinder tube and has a fixed location thereon. Accordingly the longitudinal ribs constitute tie means fixed to the cylinder tube along their full lengths so that they are not able be bent in the circumferential direction of the cylinder tube.

It has been found that an increase in the clamping force may be produced if the bearer faces 22 and 23, which are directed away from each other in the peripheral direction of each longitudinal rib, diverge in a direction away from the outer peripheral face 5 of the cylinder tube. The distance of the bearer faces, as measured in the circumferential direction, is thus smaller adjacent to the outer face 5 and increases in a direction away from it. Thus, taking as a starting point a plane tangent to a longitudinal rib and parallel to a plane extending radially and axially in relation to the cylinder tube, the respective bearer face will be inclined in relation to this plane about an axis running parallel to the longitudinal axis 10. The angle of inclination is marked $\alpha$ in FIG. 1. To put it differently, one may say that the bearer faces are set at an oblique angle to a plane which contains the respective longitudinal rib and the longitudinal rib diametrally opposite to it.

One effect due to this sort of diverging configuration is that the longer and shorter jaws will be more strongly drawn onto the longitudinal rib on tightening the longer, trunnioned jaws and the shorter jaws and are joined to it. For this reason it is an advantage as well if the respective clamping and opposite faces are so shaped that the clamping recess defined by them, which receives the respective longitudinal rib, has a shape which is complementary to the longitudinal rib.

It is more especially an advantage if the angle $\alpha$ of inclination of the bearer faces 22 and 23 is of the order of 2°. However it will also be clear that this angle may be made larger or smaller in keeping with the circumstances of a particular application.

We claim:

1. A cylinder and piston unit comprising a cylinder tube, two cylinder end caps each placed on one end of the cylinder tube, a piston able to run inside the tube axially, a piston rod fixed to said piston and extending at one side of said piston and out of said cylinder through at least one of said end caps in a sealing manner, four longitudinal means extending along said cylinder and piston unit between said end caps and being equally spaced from each other in the circumferential direction of said tube, and mounting yoke means for pivotally supporting said tube, said mounting means comprising:

at least first and second clamping jaws which are diametrally opposite to each other with respect to the cylinder tube, each of said clamping jaws having two gripping faces for engaging two of said longitudinal means that are circumferentially adjacent, said clamping jaws forming a structure placed round said tube clear of surfaces of said tube between said longitudinal means, two trunnions mounted on respective different ones of said first and second clamping jaws so as to define a pivot axis normal to a longitudinal axis of said tube and to afford a way of pivotally mounting said cylinder and piston unit, and means for connecting said clamping jaws and tightening same onto said longitudinal means so that the two gripping faces of each of the clamping jaws are simultaneously clamped onto outer surfaces of two of said longitudinal means which are adjacent to each other in the circumferential direction of the tube.

2. The cylinder and piston unit as claimed in claim 1 wherein where they are to engage outer surfaces of said longitudinal means said gripping faces have a configuration that is complementary to said outer surfaces.

3. The cylinder and piston unit as claimed in claim 1 wherein said mounting means is an annular structure completely encircling the cylinder tube, said structure being divided at each of said longitudinal menas by interruptions in the form of separating gaps into four separate clamping jaws in the form of said first and second jaws and additionally third and fourth clamping jaws which are arranged substantially diametrally opposite to each other with respect to said tube and extend between ends of said first and second clamping jaws, all clamping jaws having such gripping faces at ends thereof for engagement with said longitudinal means, said gripping faces being arranged at said interruptions and being arranged to engage each of said longitudinal means on substantially opposite sides thereof, said tightening means constituting a means of detachably connecting said clamping jaws together at the interruptions.

4. The cylinder and piston unit as claimed in claim 3 wherein said clamping jaws as viewed in the length direction of the tube are arranged at right angles to each other forming a rectangular ring, said first and second opposite clamping jaws with said trunnions being parallel to the planes of their respective trunnions and being longer than said third and fourth clamping jaws without trunnions so that the third and fourth clamping jaws extend between ends of said first and second clamping jaws with said interruptions between them.

5. The cylinder and piston unit as claimed in claim 4 wherein said interruptions extend essentially in two parallel planes, gripping surfaces formed by surfaces on each of said first and second clamping jaws being respectively coplanar.

6. The cylinder and piston unit as claimed in claim 4 wherein said third and fourth jaws have their gripping faces arranged between the interruptions and inner sides of said clamping jaws facing said tube, said gripping faces being complementary to part of the outer face of said longitudinal means to be engaged thereby.

7. The cylinder and piston unit as claimed in claim 6 wherein the length of said gripping faces of said first and second jaws as measured around said two longitudinal means engaged thereby is greater than that of the gripping faces of the third and fourth clamping jaws.

8. The cylinder and piston unit as claimed in claim 3 wherein the gripping faces of the first and second clamping jaws are adapted to engage a major part of the periphery of said longitudinal means, said major part however being less than half of the periphery.

9. The cylinder and piston unit as claimed in claim 6 wherein the gripping faces on said first and second clamping jaws are surfaces of recesses in inner sides of said first and second clamping jaws, said recess surfaces being complementary to outer surfaces of said longitudinal means.

10. The cylinder and piston unit as claimed in claim 3 wherein the gripping faces of each pair of adjacent clamping jaw ends define a recess whose cross section perpendicular to the longitudinal axis of the tube is U-like with the rounded end of the U directed radially outwards from said tube axis and with the interruption cutting through such rounded end in the form of a gap, whereas the opposite end of said U is directed radially inwards in relation to said tube.

11. The cylinder and piston unit as claimed in claim 3 wherein in the fitted condition of said mounting means there is a clearance between outer faces of said tube between said longitudinal means thereon and inner faces of said clamping jaws.

12. The cylinder and piston uint as claimed in claim 3 wherein the mounting means configured as an annular structure has an inner side which is essentially circular and coaxial to the tube and has U-like recesses evenly distributed in a circumferential direction and opening inwards, such U-like recesses having sides with an angle between them which is between zero and a small angular value so that such sides converge towards said tube.

13. The cylinder and piston unit as claimed in claim 3 wherein said third and fourth clamping jaws have slots between their ends, which slots extend radially and longitudinally with respect to said tube from inner faces of said third and fourth clamping jaws towards outer surfaces thereof so as to end short of said outer surfaces, said slots being adapted to allow deformation of said third and fourth clamping jaws on tightening.

14. The cylinder and piston unit as claimed in claim 1 wherein inner sides of said clamping jaws facing intermediate surfaces of said tube circumferentially between said longitudinal means thereon are arranged to be clear of said intermediate surfaces in the clamped position of said clamping jaws, said inner sides being complementary to said intermediate surfaces and being at a smaller distance therefrom than radially outer ends of said longitudinal means.

15. The cylinder and piston unit as claimed in claim 1 wherein said longitudinal means are in the form of longitudinal ribs formed integrally with said tube and have threaded holes in ends thereof for connection of said end caps thereto by screws.

16. The cylinder and piston unit as claimed in claim 15 wherein said longitudinal ribs have a U-like outer face in cross section with the opposite sides of the U extending generally radially from said tube to a rounded end of said U.

17. The cylinder and piston unit as claimed in claim 16 wherein sides of each of said longitudinal ribs extending from outer ends of said ribs inwards towards said tube converge slightly towards same.

18. The cylinder and piston unit as claimed in claim 16 wherein the gripping faces of said clamping jaws arranged adjacent to one such interruption are complementary to the cross section of the longitudinal rib to be engaged thereby.

19. The cylinder and piston unit as claimed in claim 1 wherein said longitudinal means are tie rods extending between said end caps and separate from said tube.

20. The cylinder and piston unit as claimed in claim 1 wherein said longitudinal means are ribs made integral with said tube.

* * * * *